US010098405B2

(12) United States Patent
Ross et al.

(10) Patent No.: US 10,098,405 B2
(45) Date of Patent: Oct. 16, 2018

(54) HEAD AND FACE PROTECTION SYSTEMS

(71) Applicant: Eye Safety Systems, Inc., Hailey, ID (US)

(72) Inventors: Brian Ross, Ketchum, ID (US); Joel Cater, Hailey, ID (US); Chris Randolph Dawson, Murietta, CA (US)

(73) Assignee: Eye Safety Systems, Inc., Hailey, ID (US)

( * ) Notice: Subject to any disclaimer, the term of this patent is extended or adjusted under 35 U.S.C. 154(b) by 68 days.

(21) Appl. No.: 14/209,404

(22) Filed: Mar. 13, 2014

(65) Prior Publication Data

US 2014/0259319 A1 Sep. 18, 2014

Related U.S. Application Data

(60) Provisional application No. 61/785,421, filed on Mar. 14, 2013.

(51) Int. Cl.
*A42B 3/18* (2006.01)

(52) U.S. Cl.
CPC ..... *A42B 3/18* (2013.01)

(58) Field of Classification Search
CPC ..... A42B 3/288; A42B 3/18; A62B 18/084
See application file for complete search history.

(56) References Cited

U.S. PATENT DOCUMENTS

| | | | | |
|---|---|---|---|---|
| 2,616,081 | A | 11/1952 | Weaver et al. | |
| 2,935,985 | A | 5/1960 | Andrews et al. | |
| 3,430,261 | A * | 3/1969 | Benner | A42B 3/166 2/209 |
| 3,873,998 | A | 4/1975 | Norris et al. | |
| 3,984,875 | A | 10/1976 | Farquaharson | |
| 4,916,759 | A | 4/1990 | Arai | |
| 5,005,926 | A | 4/1991 | Spielberger | |
| 5,190,802 | A | 3/1993 | Pilato | |
| 5,263,204 | A | 11/1993 | Butsch | |

(Continued)

FOREIGN PATENT DOCUMENTS

| | | |
|---|---|---|
| DE | 10240744 B3 | 4/2004 |
| FR | 2864753 | 7/2005 |
| WO | WO 2006/093868 | 9/2006 |

OTHER PUBLICATIONS http://ecx.images-amazon.com/images/I/51hHAUvwykL.jpg (retrieved online Jun. 3, 2010).

(Continued)

*Primary Examiner* — Anna Kinsaul
(74) *Attorney, Agent, or Firm* — Sterne, Kessler, Goldstein & Fox P.L.L.C.

(57) ABSTRACT

Multi-axis quick-release gimbal hinges that releasably attach a face protector to a helmet. The hinges allow the face protection to be easily and quickly released from the as-worn position to a position hanging from the other side of the helmet—even if the user has only a single hand free to release the face protector, and further to be fully detached from the helmet if desired. The present multi-axis quick-release gimbal comprise at least two degrees of freedom due to two gimbal hinges and also facilitate re-attachment compared to former systems, for example because the dual-gimbal hinge configuration holds the face protector in a particularly easy-access positions and/or by providing a rotational stop.

26 Claims, 6 Drawing Sheets

(56) References Cited

U.S. PATENT DOCUMENTS

| | | | | |
|---|---|---|---|---|
| 5,329,641 | A | 7/1994 | Kalhous | |
| 5,448,780 | A | 9/1995 | Gath | |
| 5,603,117 | A | 2/1997 | Hudner | |
| 5,752,298 | A | 5/1998 | Howell | |
| 6,012,164 | A | 1/2000 | Deal, III | |
| 6,237,161 | B1 | 5/2001 | Lee | |
| 6,247,811 | B1 | 6/2001 | Rhoades et al. | |
| 6,281,149 | B1 | 8/2001 | Hussein | |
| 6,481,024 | B1 | 11/2002 | Grant | |
| 6,490,729 | B1 | 12/2002 | Dondero | |
| 6,786,786 | B1 | 9/2004 | Davis | |
| 6,923,537 | B2 | 8/2005 | Hartley | |
| 7,308,721 | B1 | 12/2007 | Rivera, Jr. | |
| 2003/0070200 | A1 | 4/2003 | Crye et al. | |
| 2004/0003452 | A1 | 1/2004 | Schiebl | |
| 2005/0204446 | A1 | 9/2005 | Wright | |
| 2006/0288468 | A1* | 12/2006 | Jorgenson | A42B 1/045 2/205 |
| 2007/0050895 | A1 | 3/2007 | Broersma | |
| 2007/0186324 | A1 | 8/2007 | Sheldon | |
| 2008/0289085 | A1* | 11/2008 | Bryant | A42B 3/328 2/421 |
| 2009/0044316 | A1 | 2/2009 | Udelhofen | |
| 2011/0061152 | A1 | 3/2011 | Wismann | |
| 2014/0033406 | A1 | 2/2014 | Lebel | |
| 2014/0143937 | A1 | 5/2014 | Cram | |
| 2014/0317835 | A1 | 10/2014 | Mejia, Jr. | |
| 2015/0026858 | A1 | 1/2015 | Ross et al. | |
| 2015/0033457 | A1 | 2/2015 | Tryner | |
| 2016/0029734 | A1 | 2/2016 | Kurpjuweit | |

OTHER PUBLICATIONS

WorthSports.com, "Face First", available at: http://worthsports.com/fastpitch/protective/face-first (retrieved online Jun. 3, 2010).

* cited by examiner

HEAD AND FACE PROTECTION SYSTEMS

CROSS-REFERENCE TO RELATED APPLICATIONS

The present application claims the benefit of U.S. Provisional Patent Application Ser. No. 61/785,421, filed Mar. 14, 2013, which application is incorporated herein by reference in its entirety.

BACKGROUND

Many variations of face protectors, such as blunt force and ballistic impact protectors, for the face and or jaw have been designed in the past. Such systems are typically connected directly to the helmet via a nylon strap extending from the helmet to the face protector. However, such systems to not allow the face protector to swing freely along specified axis/axes of rotation, and many do not have simple or easy detachment and reattachment of the face protector to the helmet.

Thus, there has gone unmet a need for improved devices, systems and methods that can provide at least one of improved detachment and reattachment of facial or neck protection, and improved retention of such face protectors if detached from only one side of a helmet. Such systems can be useful, for example, for first-responders and military personnel likely to be put in harm's way such as soldiers, law enforcement officers, and firefighters.

The present systems and methods, etc., provide these and/or other advantages.

SUMMARY

The present systems, devices and methods, etc., comprise a quick-release gimbal hinge for connecting a face protector or other outer-face or mandible covering element such as an air mask, to a helmet. A first gimbal hinge release allows the face protection to quickly and easily release from the as-worn position to a position hanging from one side of the helmet. The quick-release can be accomplished by a latch mechanism with pull strap or otherwise as desired. Typically there are multi-axis gimbal hinges and releases located on both sides of the user.

The present multi-axis quick-release gimbal comprise at least two degrees of freedom due to two gimbal hinges and also facilitate re-attachment compared to former systems, for example because the dual-gimbal hinge configuration holds the face protector in a particularly easy-access positions and/or by providing a rotational stop. The rotational stop stops rotation of the gimbal hinge beyond a desired amount, for example beyond about 60°, 75°, 90° or 120°. In some embodiments the rotational stop forms a "home" position for the face mask. Thus, when the face protector is dangling, the user can rotate the face protector until it hits the rotational stop, which places the face protector in a proper position for catching on, and reattaching to, the portion of the gimbal hinge attached to the helmet, or to a strap or other extension projecting from the helmet and holding the gimbal hinge and the face protector when the face protector is in the "as-worn" position. The rotational stop can be located on either the first or the second gimbal hinge as desired.

In some embodiments, the point of attachment/detachment of the face protector to the helmet is a latch mechanism found in the multi-axis gimbal hinge. Such latch mechanism rotatably, releasably attaches to a bar or rod, which rod in the closed position forms one axis of rotation, typically about the z-axis or sagittal axis relative to the helmet or user; this axis of rotation can change orientation if the other side of the face protector is detached from the helmet and thus the face protector swings to a different position relative to the helmet and relative to the axis of rotation of the other gimbal hinge. A second axis of rotation is at the base of the latch assembly connecting the multi-axis gimbal hinge to the helmet or the suspension system attached to the helmet, and thus is located at 90° relative to the other axis of rotation. This second axis of rotation can be located along either the x-axis or y-axis relative to the helmet and user, or anywhere in between. The order of the axes in the two gimbal hinges can be reversed or inverted if desired.

Since the multi-axis gimbal hinge has at least two axes of motion, the face protector is able to swing free from the as-worn position to a hanging position. By combining the quick-release with the specified axes of motion discussed herein, the overall mechanism is simplified and improved. Thus, the face protection can be dangled away from the face and/or quickly removed for eating, drinking, donning a gas mask, CPR, first aid, etc. Similarly, the face protection can be quickly re-attached for ease or in the unfortunate situation where an emergency situation unexpectedly arises and the face protection is needed for its named purpose.

Thus, in one aspect the present systems, methods, etc. are directed to a head and face protection system comprising: a helmet sized and configured to be worn on a human head, a face-protection component configured to suspend from the helmet, and a quick-release multi-axis hinge forming a connection between the helmet and the face-protection component. The quick-release multi-axis hinge comprises a first hinge having a first axis of rotation and a second hinge having a second axis of rotation different from the first axis of rotation, and the quick-release multi-axis hinge comprises a quick-release mechanism configured to separate the connection between the helmet and the face-protection component.

The first hinge can be a first gimbal hinge and the second hinge can be a second gimbal hinge with the first gimbal hinge and the second gimbal hinge rotate about a single point, or the first gimbal hinge can be an inner gimbal hinge and the second gimbal hinge can be an outer gimbal hinge wherein the first gimbal axis of rotation and the second gimbal axis of rotation do not rotate about a single point of rotation.

The first gimbal axis of rotation and the second gimbal axis of rotation can be at about 90° from each other when the face-protection component can be in a closed position relative to the helmet. The first gimbal hinge can rotate about a generally horizontal axis relative to the helmet when the face-protection component can be in a closed position relative to the helmet. The second gimbal hinge can rotate about a vertical or horizontal axis relative to the helmet when the face-protection component can be in a closed position relative to the helmet. Either the first or second gimbal hinge can comprise the quick-release mechanism.

The first gimbal hinge and the second gimbal hinge can be in series or parallel. The second gimbal hinge can be a latch mechanism comprising a bar and a catch sized and configured to rotatably, releasably attach to the bar, and can comprise a rotational stop that stops rotation about the second gimbal axis of rotation at a predetermined position. The rotational stop prevents rotation beyond a desired amount, for example no more than about 90°. The rotational stop can for a "home" position, for example for the face mask for when it is to be re-attached to the helmet or some structure depending from the helmet.

The quick-release mechanism can be configured to release the connection in a single motion by a user. The quick-release mechanism can comprise a pull strap operably connected to a latch releasably holding first and second parts of the second gimbal hinge to each other, or a depressable button. The hinge further can comprise at least two projections extending over upper and lower surfaces of the face-protection component when it can be held in a closed position within the quick-release multi-axis gimbal hinge.

The helmet can be a Combat Vehicle Crewman (CVC) helmet or an Army Combat Helmet (ACH).

These and other aspects, features and embodiments are set forth within this application, including the following Detailed Description and attached drawings. Unless expressly stated otherwise, all embodiments, aspects, features, etc., can be mixed and matched, combined and permuted in any desired manner. In addition, various references are set forth herein; all such references are incorporated herein by reference in their entirety and for all their teachings and disclosures, regardless of where the references may appear in this application.

DETAILED DESCRIPTION

Figure 1:
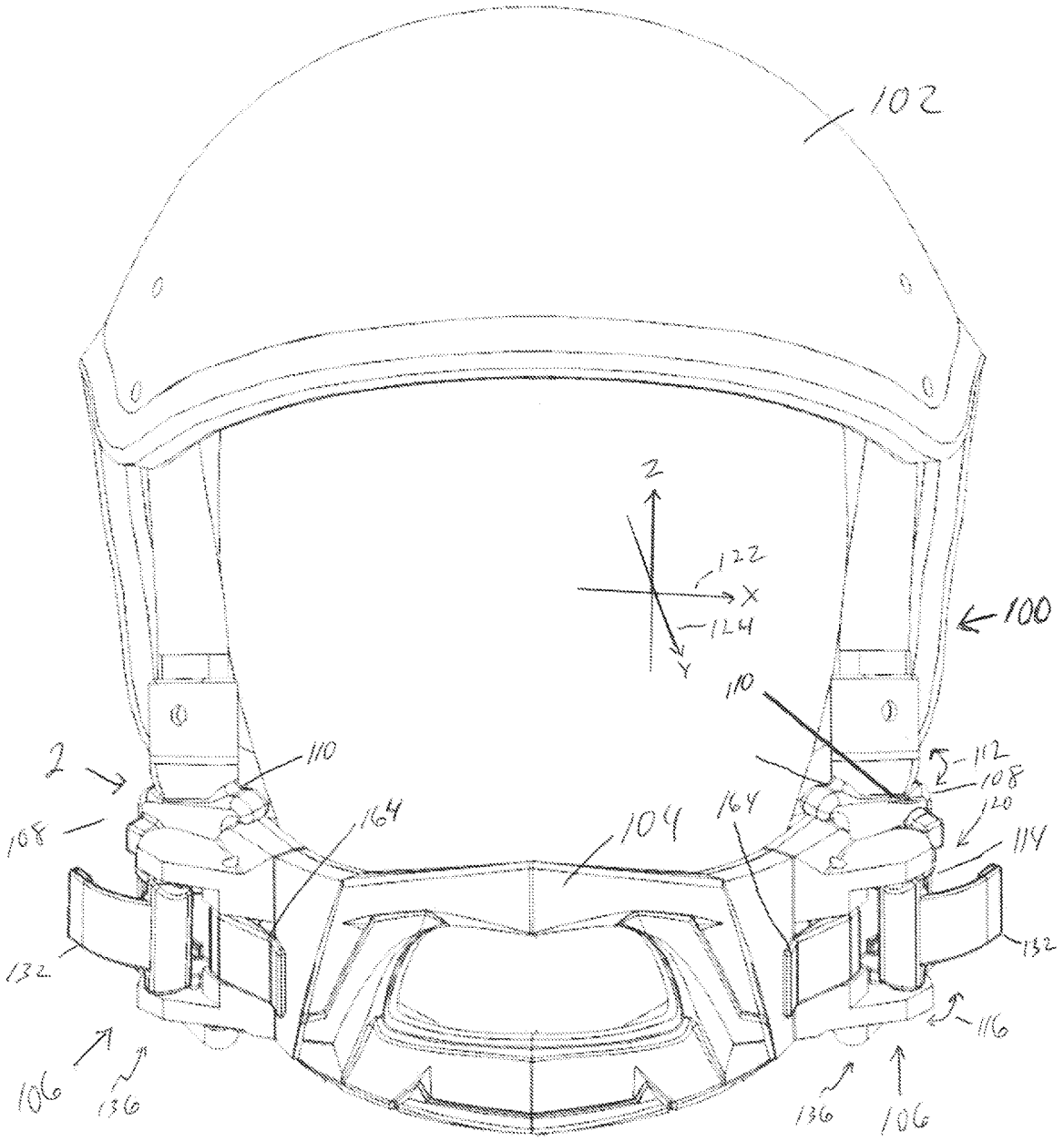
FIG. 1 depicts an exemplary head and face protection system 100 comprising a helmet, a face-protection component and a quick-release multi-axis gimbal hinge as discussed herein.

The present systems and methods, etc., provide multi-axis quick-release gimbal hinges that attach a face protector to a helmet. A first quick-release gimbal hinge on one side of the face protector/helmet allows the face protection to be easily and quickly released from the as-worn position to a position hanging from the other side of the helmet—even if the user has only a single hand free to release the face protector. This hanging position allows the user to do things that can't be done with the face protection in place in the as-worn position, yet holds the mask in a readily available position so it can be easily re-attached to the as-worn position. The present multi-axis quick-release gimbal hinges facilitate re-attachment compared to former systems, for example because the dual-gimbal hinge configuration holds the face protector in a particularly easy-access positions and/or by providing a rotational stop. Re-attachment is accomplished by rotating the face protection up towards the as-worn position until it hits the rotational stop then aligning the face protector with the latch for reattachment. In some embodiments, the systems may have alignment mechanisms other than, or in addition to, the rotational stops discussed herein. Thus, the rotational stop can form a "home" position for the face mask. The rotational stop can be located on either the first or the second gimbal hinge as desired.

Advantageously, the quick-release gimbal hinge typically comprises two axes of motion, although more can be provided in certain embodiments. This allows the face protection to swing freely yet primarily in non-obstructive movements and can help reattachment by keeping the face protection in a position where reattachment is easier than with face protectors that dangle completely without restriction.

In certain other embodiments, the quick-release gimbal hinge comprises only a single gimbal hinge, which typically extends through the helmet strap or other helmet connector. Rotation by the face protector about the hinge when the helmet is worn by a user rotates the face protector upwardly and downwardly.

If desired, a second quick-release gimbal hinge on the opposing side of the helmet and face protector can be used to remove the face protection completely from the helmet and/or to provide easy access for both left-handed and right-handed users.

Thus, in some embodiments, the systems herein comprise a helmet sized and configured to be worn on a human head, a face-protection component configured to suspend from the helmet, and a quick-release multi-axis gimbal hinge forming a connection between the helmet and the face-protection component. The quick-release multi-axis gimbal hinge comprises at least an inner gimbal hinge having a first axis of rotation and an outer gimbal hinge having a second axis of rotation at about 90° from the first axis of rotation. The multi-axis gimbal hinge can be a nested gimbal hinge wherein multiple axes rotate about a single point, and/or the inner/outer gimbal hinges can be reversed in order. Other degrees of relative orientation can also be used, for example the first and second axes of rotation can be at about 45°, 60° or 75° relative to each other. In still further embodiments, a multi-axis non-gimbal hinge can be used, such as a ball-in-socket hinge configured with multiple axes of freedom.

The quick-release hinge further comprises a quick-release mechanism such as a pull strap, pull handle, push button, or lever configured to quickly release the connection between the helmet and the face-protection component.

Turning to the Figures, FIG. 1 depicts an exemplary head and face protection system 100 comprising a helmet 102 and a face-protection component 104. In FIG. 1, helmet 102 is a stylized Combat Vehicle Crewman (CVC) helmet. Between the helmet 102 and the face-protection component 104 is a quick-release multi-axis gimbal hinge 106 providing a connection 108 between the helmet 102 and the face-protection component 104. The quick-release multi-axis gimbal hinge 106 comprises an inner gimbal hinge 110 having an inner gimbal axis of rotation 112 and an outer gimbal hinge 114 having an outer gimbal axis of rotation 116. In the embodiment shown, the outer gimbal axis of rotation 116 is about 90° from the first axis of rotation 118. Thus, as shown, the inner gimbal axis of rotation 112 rotates about a generally horizontal axis relative to the helmet or user, while the outer gimbal axis of rotation 116 is generally at a vertical axis of rotation relative to the helmet when the face-protection component 104 is in the as-worn position.

In embodiments where only a single gimbal hinge is provided, the an inner gimbal hinge 110 having an inner gimbal axis of rotation 112 is typically the location and axis of rotation of the single gimbal hinge.

Figure 2:
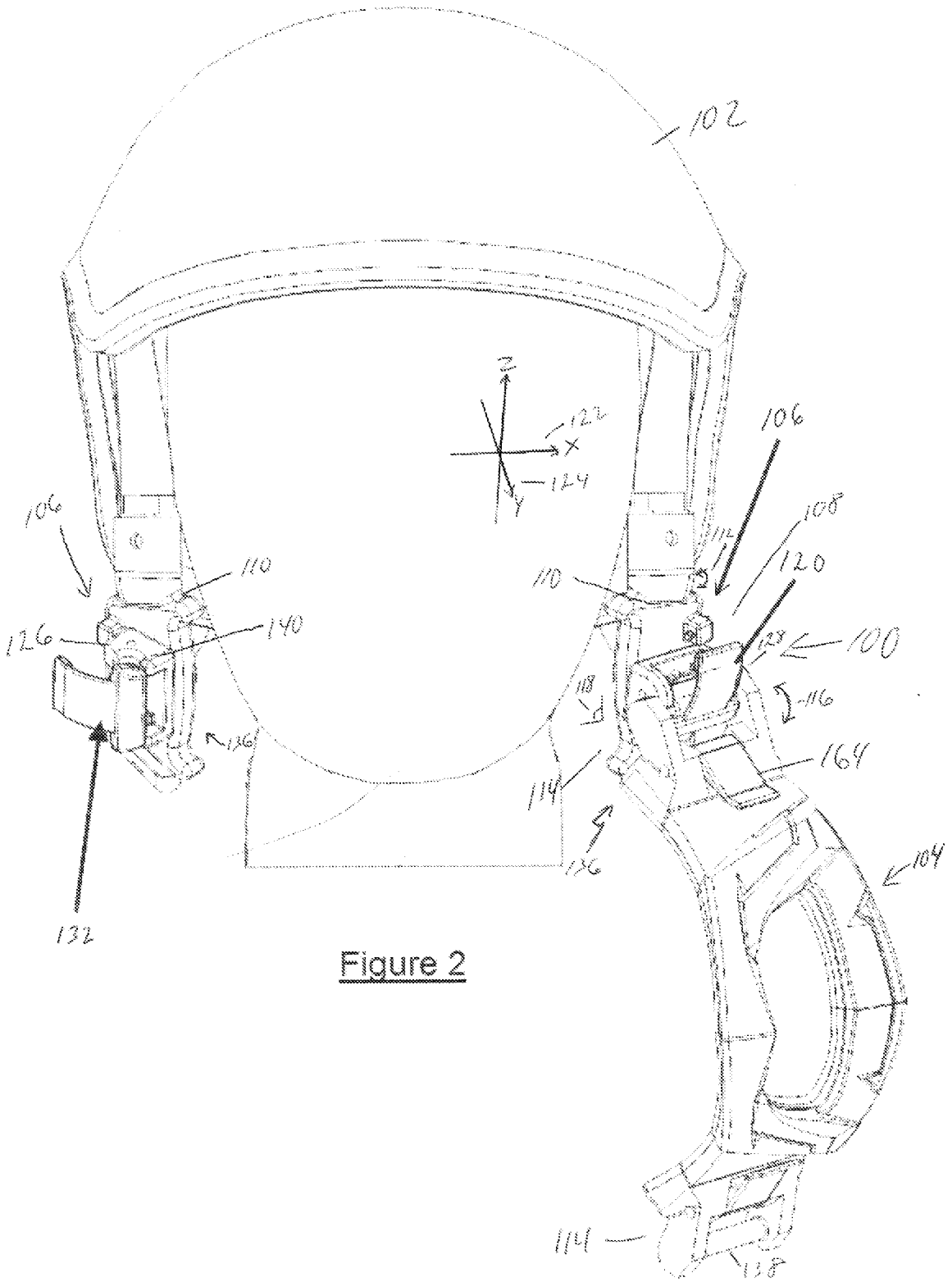
FIG. 2 depicts an exemplary head and face protection system 100 comprising a helmet, a face-protection component and a quick-release multi-axis gimbal hinge as discussed herein, with the face-protection component in an open position.
Figure 3:
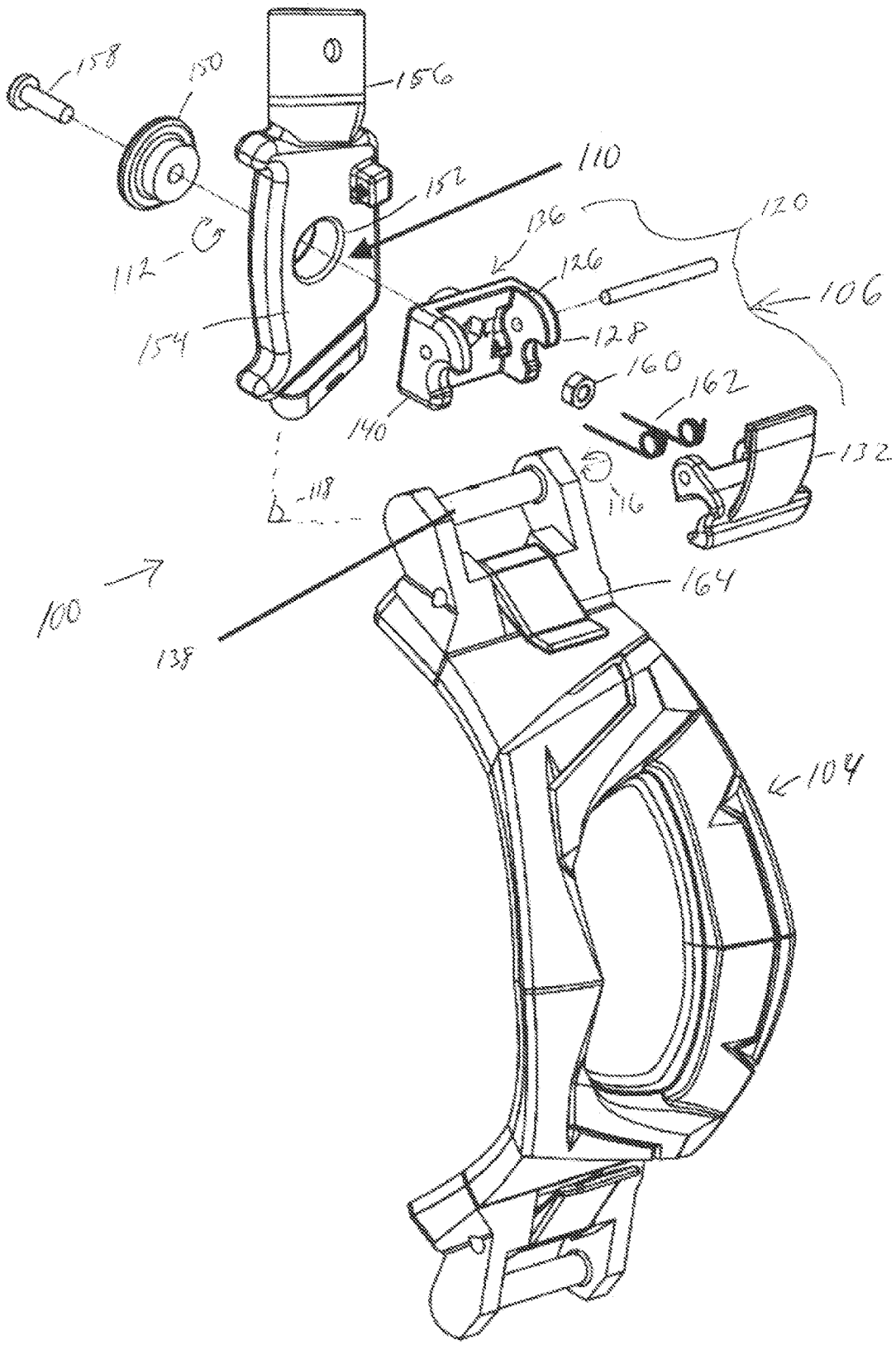
FIG. 3 depicts an exploded view of an exemplary quick-release multi-axis gimbal hinge as discussed herein.

Referring also to FIGS. 2 and 3, the quick-release multi-axis gimbal hinge 106 can also comprise a rotational stop 126 that stops rotation of the outer gimbal axis of rotation 116 at a predetermined position 128. Such predetermined position can be set at about 90° relative to the first, inner gimbal axis of rotation 112. The quick-release mechanism 120 can comprise a pull strap 132 configured for easy grasping and pulling by a user so that the face-protection component 104 can be easily disengaged from the helmet or the suspension system attached to the helmet 102. The quick-release mechanism 120 can be a latch mechanism 136 comprising a bar 138 and a catch 140 sized and configured to rotatably, releasably attach to the bar 138. The multi-axis gimbal hinges herein can be used with any suitable helmet including sports helmets, firefighter helmets, other first responder helmets, etc. The head and face protection system 100 can also comprise projections 142 that help can help capture the face-protection component 104 when it is being swung or replaced from a free or open position back into a closed position, and/or help limit unwanted movement of the face-protection component 104 relative to the quick-release multi-axis gimbal hinge 106 when in the closed position.

Turning more specifically to FIG. 3, which depicts an exploded view of an exemplary quick-release multi-axis gimbal hinge 106, inner gimbal hinge 110 comprises a post or grommet 150 that passes through opening 152 in the base 154 of inner gimbal hinge 110. Base 154 is attached to a strap or other helmet connector 156 that connects the face-protection component 104 to the helmet or the suspension system attached to the helmet 102 (helmet not shown in FIG. 3). Base 154 is also attached via bolt 158 and nut 160 to latch mechanism 136 comprising bar 138 and catch 140 that rotatably, releasably attaches to the bar 138. Multi-axis gimbal hinge 106 also comprises springs 162 to urge the parts to desired positions and/or to maintain desired positions. Outer gimbal hinge 114 can also comprise a strap cover 164 to help secure pull strap 132 in place and/or to inhibit accidental deployment of pull strap 132.

Figure 4:
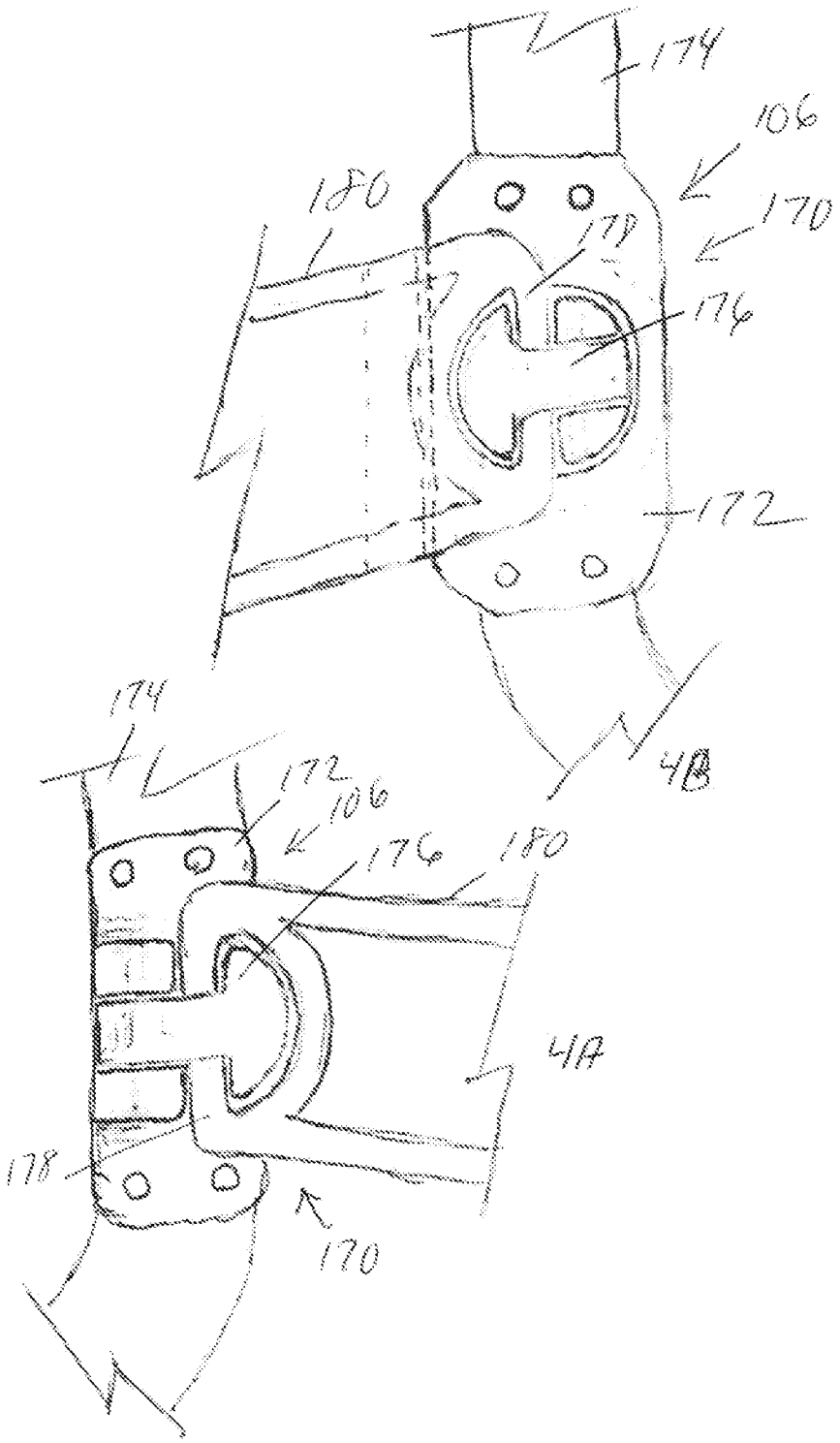
FIGS. 4A-4B depict another example of a rotation-limited gimbal hinge suitable for use with a quick-release multi-axis gimbal hinge as discussed herein

FIGS. 4A-4B depict another example of a rotation-limited gimbal hinge 170 suitable for use with a quick-release multi-axis gimbal hinge 106 as discussed herein. In this embodiment, base 172 is attached to helmet strap 174 and comprises a rod latch 176 covering a rod 178 of an extension element 180 of the rotation-limited gimbal hinge 170. The rod latch 176 can be opened so that rod 178, and thus extension element 180, can be separated from base 172.

Figure 5:
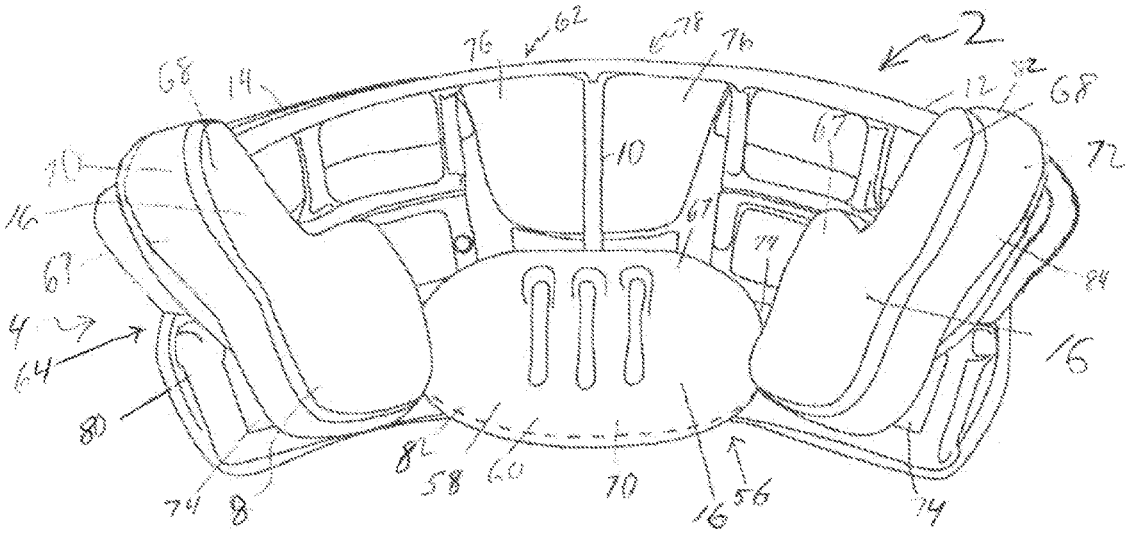
FIG. 5 depicts an alternative example of a face protection system that can benefit from the multi-axis gimbal-hinge system as discussed herein.
Figure 6:
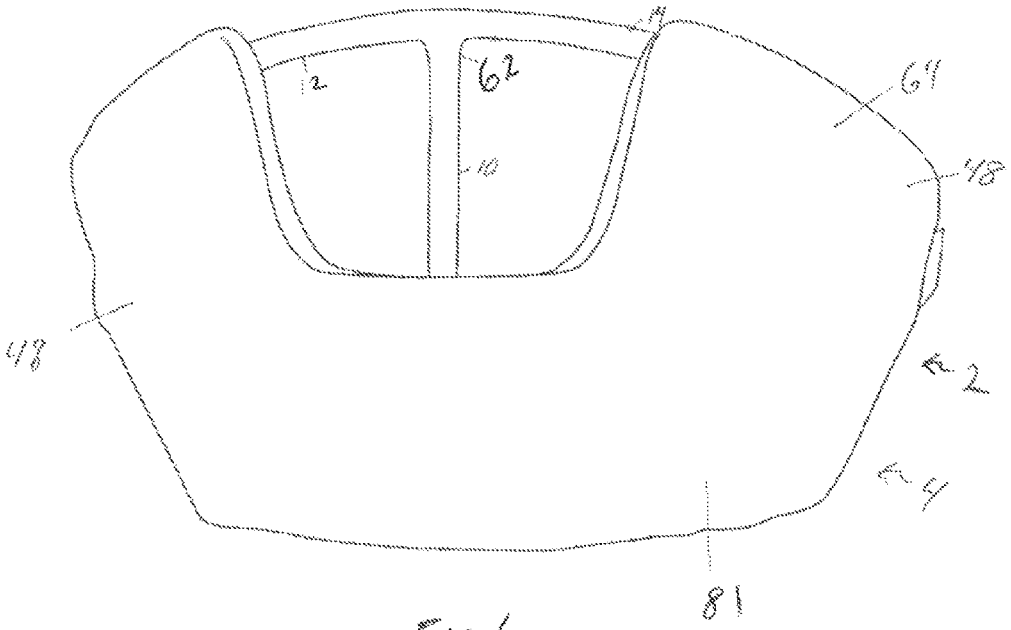
FIG. 6 depicts an alternative example of a face protection system that can benefit from the multi-axis gimbal-hinge system as discussed herein.

FIGS. 5 and 6 depict an alternative example of a face protection system that can benefit from the gimbal-hinge system, namely a face protection system as shown in co-owned U.S. patent application Ser. No. 13/153,250, entitled "Adjustable Facial Protection Systems And Methods Of Making And Using The Same," filed Jun. 3, 2011 (incorporated herein by reference in its entirety). FIGS. 5 and 6 herein correspond to FIGS. 1 and 3 in the prior application, and the reference numerals in FIGS. 5 and 6 likewise correspond to the reference numerals in that application.

FIGS. 5 and 6 depict front and rear views, respectively, of a crescent-shaped face-protection element 4 of an adjustable facial protection system 2. Briefly, the crescent-shaped face-protection element 4 is configured to withstand blunt force impact and at least one of ballistic or fragmentation projectiles and is configured to be attached to a protective helmet as discussed herein. Exemplary face-protection element 4 comprises a rigid frame 10 comprising a frame right side 12 and a frame left side 14. The face-protection element 4 further comprises at least one interior contact point 16 configured to hold the face-protection element 4 in place against a jaw or face of a user. The frame right side 12 comprises at least one right side frame attachment element and the frame left side 14 comprises at least one left side frame attachment element 26. The right side and left side frame attachment elements 24, 26 are attached to one or more corresponding pliable elongated connector elements 28 extending from the respective frame attachment elements on the protective helmet such that the distance between the face-protection element 4 and the helmet can be selectively varied.

The exemplary face-protection element 4 in FIGS. 5 and 6 comprises: a) an inner layer 56 comprising the interior contact points 16 which can be face pads 67. In this embodiment the face pads 67 comprise chin cup 70, a left cheek pad 68 and a right cheek pad 72, each comprised of an impact protection material 60. b) A substantially rigid frame layer 62 that comprises the substantially rigid frame 10, wherein the frame 10 strong is enough to resist a blunt force impact. And, c) a ballistic armor material layer 64, which comprises a material strong enough to resist both ballistic and fragmentation projectiles. The anti-ballistic layer 74 can be permanently or removably attached to at least one of the other two layers, for example via two anti-ballistic fabric attachment elements 80 configured to releasably retain the anti-ballistic layer 64 as the exterior 81 of the face-protection element 4.

The inner layer 56 comprises a crush protection material 82, for example an energy dissipating foam 84 or an energy dissipating gel 86. The inner layer 56 can be discontinuous and the pads are held to each other and to the other layers of the face protection system 2 by at least one pad strap 74 or other coupling mechanism, which as shown extends from one side of the face protection system 2 to the other.

The attachment of the facial protection system 2 to the protective helmet comprises one or more quick release mechanisms such that at least one side of the face-protection element 4 can be quickly released in a single motion by a user from the protective helmet. The quick release mechanism can be provided on both or either the right side and left side of the face-protection element 4 to quickly release a part of or the entire face-protection element 4 from the protective helmet. The quick release mechanisms can also be, for example, a snap or a lever.

The substantially rigid frame 10 can be ventilated with a plurality of ventilation holes 76 configured to pass substantial amounts of air from the exterior to the user 22. The ventilation holes 76 can comprise between about 20 percent to 30 percent of the surface area 78 of the substantially rigid frame 10 as in FIG. 5, or as much as 50 percent, 80 percent, 90 percent, 95 percent or more of the surface area 78 of the substantially rigid frame 10.

Figure 7:
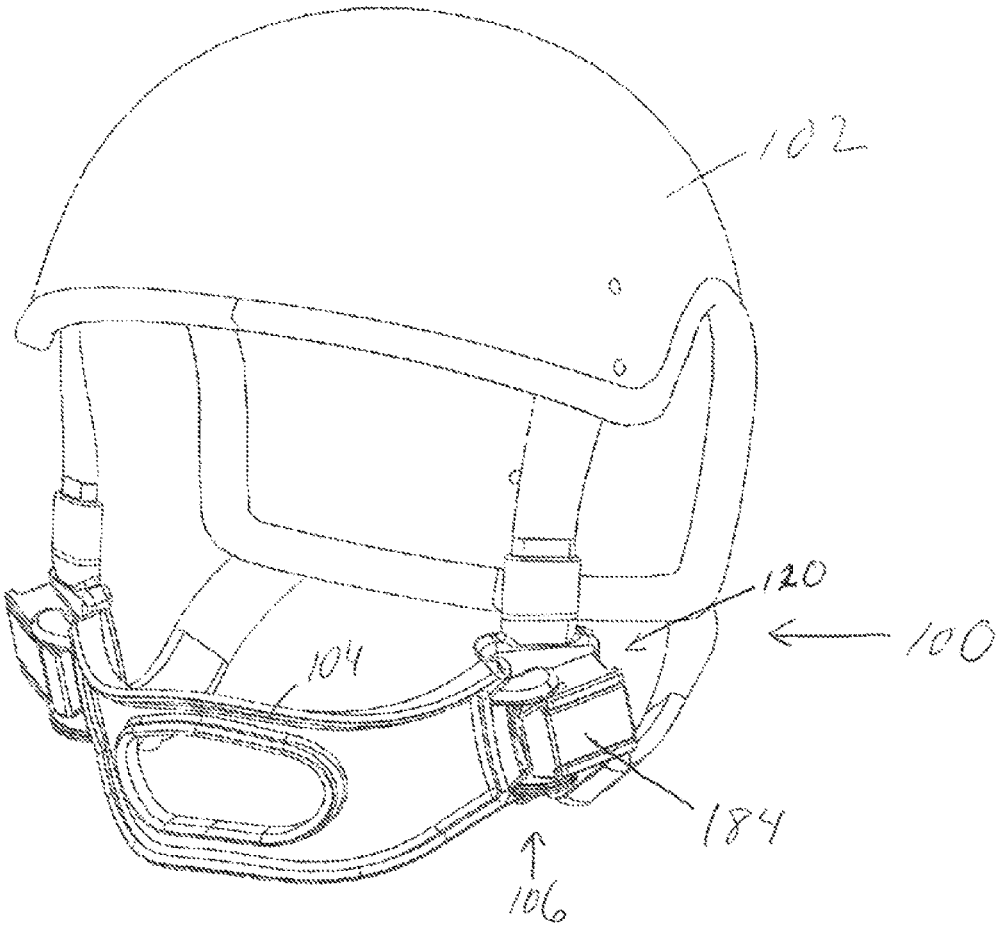
FIG. 7 depicts an exemplary head and face protection system with a depressable button as the quick-release mechanism 184.

FIG. 7 depicts an exemplary head and face protection system 100 comprising a helmet 102, face-protection component 104 and quick-release multi-axis gimbal hinge 106 similar to the systems shown in FIGS. 1-4 above, except that quick-release mechanism 120 is a depressable button 184. In use, a person wearing the helmet pushes down on depress able button 184 which activates the release and thus separates helmet 102 from face-protection component 104. In addition, in FIG. 7 the inner hinge, covered by other elements of the overall hinge 106 in the figure, is a non-gimbal, ball-in-socket hinge 186 having multiple axes of freedom.

Turning to a further general discussion of the present systems, methods, herein, such provide, in certain aspects, the adjustable facial protection system is sized and configured to cooperatively interact (or avoid, as appropriate) other items worn by a user such a headsets, microphones, electronics, etc. Further, the facial protection system can also incorporate a headset, microphone, other electronics and other functional devices, etc., within the facial protection system itself. For example, a microphone and a water delivery tube can be incorporated into the facial protection system.

The facial protection system can also comprise a neck protector, for example one made of a material strong enough to resist a variety of ballistic and/or fragmentation projectiles. In some embodiments, the neck protector can move independently of the face-protection element and is sized to cover at least a substantial portion of a neck of a user. The quick release mechanism can comprise, for example a pin and hole retention and release mechanism, or a detent retention and release mechanism, or a button retention and release mechanism.

The facial protection system can be suitable for a military helmet such as a Combat Vehicle Crewman (CVC) helmet, and the substantially rigid frame 10 can comprise multiple frame pieces. For example, two opposing frame pieces can join in a center region to provide an expandable joint, or can be a three-piece frame. This can provide adjustability in lateral directions to accommodate faces of different widths and shapes. The facial protection system can also comprise ventilation holes.

The facial protection system can include a tensioner member such as a helmet strap extending from the face-protection element to and/or around the helmet. The extensioner member can be any desired tensioner, such as a cloth strap, an elasticized strap, a spring, etc. and can connect at any desired location on the facial protection system typically the face-protection element to any other suitable location such as the helmet, the neck of the user, etc.

The facial protection system can also include a transparent or optical face shield. An exemplary transparent or optical face shield is sized and disposed to cover at least a nose and eyes of a user and extends upwardly from the face-protection element. The transparent or optical face shield can be releasably attached to the face-protection element, and can be spaced from the forward lip of the protective helmet by a fending standoff element or other spacer as desired.

The systems herein typically comprise a 2-point suspension from the helmet to the face mask or protector but can have only one or three or more attachment points as desired.

The protection system can be size-adjusted to fit on any desired helmet, such as hockey goalie helmets, football helmets, Combat Vehicle Crewman (CVC) helmets, and Army Combat Helmet (ACH) helmets.

The devices, systems, etc., herein can, if desired, be integrated into, worn alongside, and/or replace existing helmet suspension systems, e.g., existing chin straps, etc.

The protective devices herein can be, for example, "sport-level" and "military/law enforcement-level." As used herein, "sport-level" indicates face protection capable of withstanding the impacts and traumas experienced in sports such as football, hockey and baseball, while "military/law enforcement-level" means law enforcement officers, firefighters, soldiers, sailors, and the like, i.e., personnel who are likely to encounter heavy blunt force impacts such as vehicle crashes, bats, truncheons, thrown rocks and ballistic impacts such as .22 caliber and 9-millimeter and .44 magnum bullets as well as fragmentations from anti-personnel devices such as grenades and improvised explosive devices (IEDs). Thus, a military/law enforcement-level protection system herein typically meets or exceeds the 2010 National Institute of Justice (NIJ) Level IIIA helmet standards for the helmets herein, 2010 NIJ IIIA standards for body armor, and the face-protection element and ballistic armor meets or exceeds or MIL-DTL-43511D and/or the 2010 NIJ Level I, Level IIA, or Level II body armor standards, as desired.

Thus, exemplary face masks that can be used with the systems herein include hockey goalie masks, football masks, and military-level masks that comprise a rigid frame layer to provide a "skeleton" maintaining the form and structure of the face mask, which frame may be fully continuous, discontinuous and/or ventilated. The military face mask can also comprise a ballistic armor material such as soft armor (aramids and others) or hard armor (ceramics and others). This combination provides ballistic and/or fragmentation protection with blunt force protection via impact load distribution over a larger area. Either the ballistic protection element or the rigid frame can be on the outside of the overall face mask.

The present application is further directed to methods of making the various elements of the systems and apparatus herein, including making the systems and apparatus themselves from such elements, as well as to methods of using the same, including for example applying the quick-release multi-axis gimbal hinge to a particular helmet, manipulating the various quick-release multi-axis gimbal hinges or the elements thereof, and removing/separating partially or completely the quick-release multi-axis gimbal hinges, or otherwise as desired.

All terms used herein are used in accordance with their ordinary meanings unless the context or definition clearly indicates otherwise. Also unless expressly indicated otherwise, in the specification the use of "or" includes "and" and vice-versa. Non-limiting terms are not to be construed as limiting unless expressly stated, or the context clearly indicates, otherwise (for example, "including," "having," and "comprising" typically indicate "including without limitation"). Singular forms, including in the claims, such as "a," "an," and "the" include the plural reference unless expressly stated, or the context clearly indicates, otherwise.

The scope of the present devices, systems and methods, etc., includes both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a "step plus function" relationship unless the word "step" is specifically recited in a claim, and are to be interpreted as indicating a "step plus function" relationship where the word "step" is specifically recited in a claim.

From the foregoing, it will be appreciated that, although specific embodiments have been discussed herein for purposes of illustration, various modifications may be made without deviating from the spirit and scope of the discussion herein. Accordingly, the systems and methods, etc., include such modifications as well as all permutations and combinations of the subject matter set forth herein and are not limited except as by the appended claims or other claim having adequate support in the discussion and figures herein.

The invention claimed is:

1. A head and face protection system comprising: a helmet sized and configured to be worn on a human head, a face-protection component configured to extend between opposing sides of the helmet, and a quick-release multi-axis hinge forming a connection between the helmet and the face-protection component, the quick-release multi-axis hinge comprising a first hinge having a first axis of rotation and a second hinge having a second axis of rotation different from the first axis of rotation, and wherein the quick-release multi-axis hinge further comprises a quick-release mechanism configured to separate the connection between the helmet and the face-protection component, wherein the second hinge is a latch mechanism comprising a bar and a catch sized and configured to rotatably, releasably attach to the bar.

2. The head and face protection system of claim 1 wherein the first hinge is a first gimbal hinge and the second hinge is a second gimbal hinge.

3. The head and face protection system of claim 2 wherein the first gimbal hinge and the second gimbal hinge rotate about a single point.

4. The head and face protection system of claim 2 wherein the first gimbal hinge is an inner gimbal hinge comprising a first gimbal axis of rotation, and the second gimbal hinge is an outer gimbal hinge comprising a second gimbal axis of rotation, and wherein the first gimbal axis of rotation and the second gimbal axis of rotation do not rotate about a single point of rotation.

5. The head and face protection system of claim 2 wherein the first gimbal hinge comprises a first gimbal axis of rotation and the second gimbal hinge comprises a second gimbal axis of rotation, and wherein the first gimbal axis of rotation and the second gimbal axis of rotation are at about 90° from each other when the face-protection component is in a closed position relative to the helmet.

6. The head and face protection system of claim 2 wherein the first gimbal hinge comprises a first gimbal axis of rotation disposed in a generally horizontal axis relative to the helmet when the face-protection component is in a closed position relative to the helmet.

7. The head and face protection system of claim 2 wherein the second gimbal hinge comprises a second gimbal axis of rotation disposed in a vertical axis relative to the helmet when the face-protection component is in a closed position relative to the helmet.

8. The head and face protection system of claim 2 wherein the second gimbal hinge comprises the quick-release mechanism.

9. The head and face protection system of claim 2 wherein the first gimbal hinge and the second gimbal hinge are in series.

10. The head and face protection system of claim 2 wherein the quick-release multi-axis hinge comprises a rotational stop that stops rotation about at least one axis of rotation at a predetermined position.

11. The head and face protection system of claim 10 wherein the rotational stop is on the second gimbal hinge.

12. The head and face protection system of claim 10 wherein the rotational stop prevents rotation beyond about 90°.

13. The head and face protection system of claim 10 wherein the rotational stop forms a home position for the face-protection component such that when the face-protection component hits the rotational stop, the face-protection component is in a desired position for reattaching separated portions of the first gimbal hinge and the second gimbal hinge to each other.

14. The head and face protection system of claim 2 wherein the quick-release mechanism is configured to release the connection in a single motion by a user.

15. The head and face protection system of claim 14 wherein the quick-release mechanism comprises a pull strap operably connected to a latch releaseably holding first and second parts of the second gimbal hinge to each other.

16. The head and face protection system of claim 2 wherein the helmet is configured to expose a wearer's ears.

17. The head and face protection system of claim 2 wherein the quick-release mechanism is a depressable button.

18. The head and face protection system of claim 2 further comprising at least two projections, extending over upper and lower surfaces of the face-protection component when it is held in a closed position within the quick-release multi-axis hinge.

19. The head and face protection system of claim 14, wherein the quick-release mechanism is a depressable button.

20. The head and face protection system of claim 1, further comprising a second quick-release multi-axis hinge forming a second connection between the helmet and the face-protection component, the first connection and the second connection respectively disposed on the opposing sides of the helmet.

21. The head and face protection system of claim 1 wherein the face-protection component is configured to cover at least a jaw of a user.

22. A head and face protection system comprising: a helmet sized and configured to be worn on a human head, a face-protection component configured to suspend from the helmet, and a quick-release multi-axis hinge forming a connection between the helmet and the face-protection component, the quick-release multi-axis hinge comprising a first hinge having a first axis of rotation and a second hinge, and wherein the quick-release multi-axis hinge further comprises a quick-release mechanism configured to separate the connection between the helmet and the face-protection component, wherein the first hinge is a first gimbal hinge and the second hinge is a second gimbal hinge, and wherein the second gimbal hinge is a latch mechanism comprising a bar and a catch sized and configured to rotatably, releasably attach to the bar.

23. A head and face protection system comprising:

a helmet sized and configured to be worn on a human head, a face-protection component configured to extend across a wearer's face from one side of the helmet to an opposing side of the helmet, and a quick-release multi-axis hinge comprising a latch mechanism having a quick-release mechanism configured to separate a connection between the helmet and the face-protection component, the latch mechanism forming at least part of:

a first hinge having a first axis of rotation, and a second hinge having a second axis of rotation different from the first axis of rotation, wherein the first hinge and second hinge are nested.

24. The head and face protection system of claim 23 wherein the latch mechanism comprises a bar and a catch sized and configured to rotatably, releasably attach to the bar.

25. The head and face protection system of claim 24 wherein the second axis of rotation is generally perpendicular to the first axis of rotation.

26. The head and face protection system of claim 24 further comprising an elongate member configured to couple the helmet and the face-protection component, the elongate member comprising the quick-release multi-axis hinge at or proximate an end of the elongate member.

* * * * *